US010981583B2

(12) United States Patent
Krug et al.

(10) Patent No.: US 10,981,583 B2
(45) Date of Patent: Apr. 20, 2021

(54) WIND DIRECTIONAL SYSTEM FOR ARRANGEMENT BETWEEN TWO VEHICLE PARTS OF A RAIL VEHICLE

(71) Applicant: Hübner GmbH & Co. KG, Kassel (DE)

(72) Inventors: Lars Krug, Immenhausen (DE); Andreas Wiegrefe, Fulda/Berhards (DE)

(73) Assignee: HÜBNER GMBH & CO. KG, Kassel (DE)

( * ) Notice: Subject to any disclaimer, the term of this patent is extended or adjusted under 35 U.S.C. 154(b) by 426 days.

(21) Appl. No.: 16/014,560

(22) Filed: Jun. 21, 2018

(65) Prior Publication Data

US 2018/0370549 A1 Dec. 27, 2018

(30) Foreign Application Priority Data

Jun. 21, 2017 (DE) ..... 10 2017 113 761.0

(51) Int. Cl.
*B61D 17/22* (2006.01)
*B61D 17/20* (2006.01)
*B61D 17/02* (2006.01)

(52) U.S. Cl.
CPC ..... *B61D 17/22* (2013.01); *B61D 17/20* (2013.01); *B61D 17/02* (2013.01)

(58) Field of Classification Search
CPC ..... B61D 17/00; B61D 17/02; B61D 17/20; B61D 17/22
See application file for complete search history.

(56) References Cited

U.S. PATENT DOCUMENTS 2,843,417 A * 7/1958 Georg Wahl ..... B60D 5/00 280/403
3,410,226 A * 11/1968 Krupp ..... B61D 17/22 105/10
3,897,970 A * 8/1975 Gattenby ..... B60P 3/32 296/166
4,518,168 A * 5/1985 Belter ..... F16J 15/123 277/601
4,727,814 A * 3/1988 Nielsen ..... B61D 17/20 105/1.1
4,736,688 A * 4/1988 Ando ..... B61D 17/22 105/17

(Continued)

FOREIGN PATENT DOCUMENTS

DE 3634641 A1 4/1988
DE 202010001793 U1 6/2010

(Continued)

OTHER PUBLICATIONS

European Search Report dated Nov. 19, 2018; European Application No. 18 171 399.1.

*Primary Examiner* — Jason C Smith
(74) *Attorney, Agent, or Firm* — Dinsmore & Shohl LLP

(57) ABSTRACT

A fairing for arrangement between two vehicle parts, in particular of a rail vehicle, movably connected to one another, having at least one fairing element that is arranged at a respective vehicle part, that is elastically deformable, and that has a U-shaped or arcuate cross-section. The fairing also has at least one stabilization body that extends at least sectionally into the fairing element and extends from at least one front face of the fairing element.

14 Claims, 3 Drawing Sheets

(56) References Cited

U.S. PATENT DOCUMENTS

| | | | | | |
|---|---|---|---|---|---|
| 4,746,160 | A * | 5/1988 | Wiesemeyer | B62D 35/001 105/1.1 |
| 5,060,578 | A * | 10/1991 | Carimentrand | B61D 3/181 105/18 |
| 2004/0187725 | A1* | 9/2004 | Kennedy | B61D 17/22 105/8.1 |
| 2018/0370549 | A1* | 12/2018 | Krug | B61D 17/20 |
| 2019/0100221 | A1* | 4/2019 | Kroiss | B61C 17/00 |

FOREIGN PATENT DOCUMENTS

| | | | |
|---|---|---|---|
| DE | 102011003025 | A1 | 7/2012 |
| JP | H0679682 | A | 11/1994 |
| JP | H08169335 | A | 7/1996 |
| JP | 2003112625 | A | 4/2003 |
| RU | 2025293 | C1 | 12/1994 |
| RU | 77230 | U1 | 10/2008 |
| WO | 2017009069 | A1 | 1/2017 |

* cited by examiner

WIND DIRECTIONAL SYSTEM FOR ARRANGEMENT BETWEEN TWO VEHICLE PARTS OF A RAIL VEHICLE

CROSS-REFERENCE TO RELATED APPLICATIONS

This application claims priority of German Patent Application 10 2017 113 761.0 filed Jun. 21, 2017.

FIELD OF THE INVENTION

The present invention relates to a wind directional device for arrangement between two vehicle parts, in particular of a rail vehicle, that are movably connected to one another, comprising at least one wind directional element that is arranged at a respective vehicle part, that is elastically deformable, and that has a U-shaped or arcuate cross-section. The invention is furthermore directed to a wind directional element for forming a wind directional device composed of at least one such wind directional element. Such wind directional devices are also known in technical terminology by the term "fairings" that will be used in the present application.

BACKGROUND OF THE INVENTION

DE 20 2010 001 793 U1, for example, discloses a fairing forming the category that is configured for arrangement between two vehicles parts of a rail vehicle movably connected to one another. The fairing has a plurality of fairing elements that are arranged at the outer margin at the front face of the vehicle part. The fairing elements here form respective sections of the fairing running around at the margin and attached to the front face at a respective vehicle part. The fairing elements abut one another at the front faces with respect to their longitudinal directions due to their at least sectionally peripheral arrangement, with it being indicated that the fairing elements are laterally preloaded with respect to one another by the mounting at the front face of the vehicle parts. If the fairing were to be configured from a single-part peripheral fairing element, this fairing element would suffer from a high mass, would be difficult to manufacture and difficult to install, and would consequently also only be able to be replaced as a whole.

In operation of a rail vehicle, a displacement arises between the vehicle parts in the region of the transition, in particular in the vertical direction and in the lateral direction; in addition, the vehicle parts carry out a jack-knife movement with respect to one another so that forces act on the fairing elements that also effect an elastic deformation with an individual arrangement of fairing elements. A deformation movement in the lateral direction in particular takes place in addition to the sliding movement over the contact surfaces of the oppositely disposed fairing elements on movements in the transverse displacement direction between the vehicle parts so that shoulders can disadvantageously result in the region of the transition between two fairing elements at a common vehicle part due to displacement movements. With rail vehicles moving at a fairly high speed, gap formations between the fairing elements are to be avoided; the front surfaces of the fairing elements moreover wear out by pressing against one another under the application of force and experience increased friction with respect to one another due to the displacement movement.

SUMMARY OF THE INVENTION

The object of the invention relates to the further development of a fairing for arrangement between two vehicle parts of a rail vehicle movably connected to one another, in which a lateral movement of the fairing elements is reduced and a displacement movement of the fairing elements at a common vehicle part adjacent to one another at front faces is in particular avoided. Any friction between the fairing elements occurring over their front faces should in particular be minimized; it is moreover the object to avoid any gap formation in the fairing and to extend the service life of the fairing elements.

To achieve the above object, the invention provides a stabilization body that extends at least sectionally into the fairing element and is led out thereof at at least one front face of the fairing element.

The basic idea of the invention makes provision for the achievement of the above object to stabilize the fairing element by the stabilization body per se and/or to stabilize it by the leading out of the stabilization body and a possible linking or continuation of the stabilization body to a body or against a further body to reduce an elastic lateral movement. It is sufficient for the achievement of the accompanying advantages here to fasten the stabilization body led out of the fairing element in only an advantageous manner such that a supporting and stabilizing force can be exerted on the fairing element via the stabilization body.

A special advantage is achieved if a plurality of fairing elements for forming the fairing are arranged at the vehicle parts that adjoin one another at front faces with respect to their longitudinal directions, with a first section of the stabilization body extending into a first fairing element and a second section extending into an adjacent second fairing element.

If the fairing elements are placed with front faces next to one another, an even shorter stabilization body can already be sectionally introduced into both fairing elements to mutually stabilize the ends of the fairing elements adjacent to one another so that a displacement movement of the fairing elements transversely to their longitudinal directions is suppressed. If a displacement movement takes place between the vehicle parts and if the plurality of fairing elements of the fairing are subject to differently high transverse forces, the stabilization body has the effect that on an elastic transverse deformation of a fairing element, the adjacent fairing element is likewise at least partly taken along with the transverse deformation, whereby a total deformation is reduced and a stabilization effect is achieved. The special advantage moreover arises that the plurality of fairing elements connected to the at least one stabilization body have a higher stiffness in the transverse direction so that an elastic transverse deformation of the fairing elements only starts with a considerable delay and the fairing elements slide off better against one another over their contact surfaces even at a higher contact force when a movement between the vehicle parts takes place, in particular in an inner curve of a path section that is, for example, traveled by the rail vehicle.

In accordance with a possible embodiment, the fairing element has at least one mounting passage into which the oppositely disposed sections of the stabilization body extend. The mounting passage passes through the fairing element in parallel with its longitudinal direction here, with the mounting passage being able to be configured as a kind of blind bore in the front face of the fairing element or as a continuous passage from front face to front face of the fairing element. The design of the mounting passage in cross-section is here advantageously adapted to the cross-sectional shape of the stabilization body.

The fairing element that is designed with a U shape or with an arcuate shape further advantageously has a hollow chamber, with the mounting passage being formed in the hollow chamber. The fairing element is formed in a manner known per se from a substantially shape-stable thicker elastomer body and the mounting passage is, for example arranged at or attached to or integrated in the inner side or the outer side of the U-shaped or arcuate material wall. The U-shaped or arcuate material wall for forming the fairing element has a contact surface at the front face on the outer side, said contact surface being in contact sliding off over one another with the contact surface of the fairing element arranged at the oppositely disposed vehicle part. The at least one mounting passage for mounting the at least one stabilization body is here preferably located at the front side in the hollow space of the fairing elements, said front side being adjacent at the inner side to the outer-side contact surface. A particularly effective stabilization of the fairing elements thereby arises to avoid a displacement occurring between them.

In accordance with a continuative configuration of the fairing, the fairing element has at least one material section that projects into the hollow chamber and forms the mounting passage. The fairing element can, for example, be manufactured from an elastomer in an extrusion process so that the material section can be formed in a simple manner by means of a corresponding design of an extrusion die without further worksteps being necessary. Consequently, the material section for arching around the mounting passage is formed in one part and with material unity with the material of the wall of the fairing element, in particular by an elastomer.

In accordance with a first variant of the invention, the stabilization body is formed by a bar or by a rod whose oppositely disposed sections extend with into the fairing elements adjacent to one another at front faces. The mounting passage in the fairing element can for this purpose be designed, for example, as a blind hole and the bar or rod can be easily pressed into the mounting passage due to a corresponding oversize so that the bar or rod is introduced without clearance into the mounting passage and is therefore arranged in a self-holding manner. Such a variant of the stabilization body is advantageously shape-stable and thus flexurally rigid and the bar or rod can be formed from a plastic material, from an elastomer, from a metallic material or the like.

In accordance with a second variant of the invention, the stabilization body is formed by a pulling means, in particular by a rope, by a belt, or by a chain that is respectively led through the mounting passage. The further advantage thus results that the mounting passage can extend in the longitudinal direction over the peripheral length of the fairing elements and the pulling means can extend overall through these mounting passages, with the stabilization body, that is the rope, the belt, or the chain, being able to pass through the mounting passages of at least two, of more than two, or of all the fairing elements. The further advantage results here that a tension can be applied to the rope, to the belt, or to the chain. A special stability is hereby generated between the fairing elements since the latter are tensioned toward one another at front faces when a tension is applied to the pulling means. The advantage arises through the semi-rigid or flexible properties of the rope, of the belt, or of the chain that this form of the pulling means can adapt to the extent of the mounting passages in the plurality of fairing elements.

The pulling means can therefore be tensioned in itself or provision can be made that the ends of the pulling means are tensioned against the front wall of the vehicle part or against another body of the installation environment. A tensioning means in the pulling means can here serve to apply a tension to the pulling means. The tensioning means in particular comprises a spring element to achieve a permanent tensioning with a flat tensioning characteristic.

In accordance with an advantageous further development of the fairing in accordance with the invention, at least one installation section is provided for arranging the fairing element at a vehicle part, with a first side, in particular an oppositely disposed first side of said installation section being arranged at the vehicle part and with the at least one fairing element being arranged at a second side thereat The use of installation sections for arrangement between the fairing element and the front face of the vehicle part enables a more flexible design of the fairing and the same fairing elements can be used for, for example different distances between the vehicle parts if correspondingly adapted installation sections are used. The height of the installation sections, that is the distance between the first side and the second side can be adapted such that the oppositely disposed fairing elements press against one another with the required operating force. In addition, the use of installation sections facilitates the installation of the fairing at the front face of the vehicle part.

At least one fairing element can advantageously have a window-shaped cut-out through which the hollow chamber is accessible from an outer side of the fairing element, with the cut-out also being able to extend over the total length of the fairing element. It is in particular advantageous if the window-shaped cut-out faces into the inner side of a transition since an inner contour can thus be formed better on a bending of the fairing element since the cut-outs can permit an improved compression of the material of the fairing element at the inner side.

If the cut-out extends over the total length of the fairing element, a degenerated U-shaped or arcuate cross-section of the fairing element arises since the cut-out permits the lack of a limb of the cross-sectional section over the total length of the fairing element. A missing limb of the cross-sectional section is possible when the stabilization body stabilizes an otherwise elastic fairing element in the mounting passage. The missing limb is here preferably located on the inner side of the fairing that faces toward the walkable region of the transition or toward an inner bellows. The missing limb can also only be provided over a partial length of the fairing element, for example, over the lower side of the transition to provide construction space for further components.

The invention is further directed to a fairing element of a fairing for arrangement between two vehicle parts, in particular of a rail vehicle, movably connected to one another comprising a U-shaped or arcuate cross-section having a hollow chamber and provision is made in accordance with the invention that a mounting passage is formed in the cross-section of the fairing element, into which mounting passage a stabilization body can be introduced for the stabilization of the fairing element. The further features and associated advantages of the fairing elements that are listed above in connection with the fairing in accordance with the invention are likewise considered for the fairing element in accordance with the invention.

The fairing element in particular has one or more material components, with at least one material component forming a material section that projects into the hollow chamber and produces the mounting passage. The material section with the hollow space is here particularly advantageously arranged at the head-side end of the fairing element to achieve a particularly effective stiffening of the fairing element in the transverse direction when a stabilization body is at least sectionally led through the mounting passage.

In accordance with a further aspect of the invention, provision is made that with a U-shaped design of the fairing element having a base section for forming an outer-side contact surface and having the limbs projecting from the base section, the mounting passage is formed in a corner region between the base section and one of the limbs in the cross-section of the fairing element. The mounting passage is here preferably located in a corner region on the inner side of the fairing that faces toward the walkable region of the transition or toward an inner bellows since with a tensile force action, the fairing or fairings can be pulled radially inwardly into the transition. Provision can naturally also be made that a respective one mounting passage having stabilization bodies received therein is arranged in both corner regions.

Alternatively to this, with an arcuate formation of the fairing element with a peak section present between the limbs for forming the contact surface, the mounting passage is formed in the peak section of the fairing element so that a lateral symmetry is present in the cross-section of the fairing element. An arcuate design of the fairing element in the present case describes in a delineation from a rather box-like U-shaped design that no edges of the fairing element are present in cross-section that bound the contact surface at the outer side.

BRIEF DESCRIPTION OF THE DRAWINGS

Reference will now be made in detail to the preferred embodiments of the present invention, examples of which are illustrated in the accompanying drawings. Wherever possible, the same reference numbers will be used throughout the drawings to refer to the same or like parts. In addition, although the terms used in the present invention are selected from generally known and used terms, some of the terms mentioned in the description of the present invention have been selected by the applicant at his or her discretion, the detailed meanings of which are described in relevant parts of the description herein. Furthermore, it is required that the present invention is understood, not simply by the actual terms used but by the meaning of each term lying within. In the drawings.

DETAILED DESCRIPTION OF THE INVENTION

The present invention provides various embodiments of fairing. Such fairings may take a variety of forms. Certain examples of the present invention are shown in the figures. However, the present invention is not limited to the illustrated embodiments. Additional advantages, objects, and features of the invention will be set forth in part in the description that follows and in part will become apparent to those having ordinary skill in the art upon examination of the following or may be learned from practice of the invention.

Figure 1:
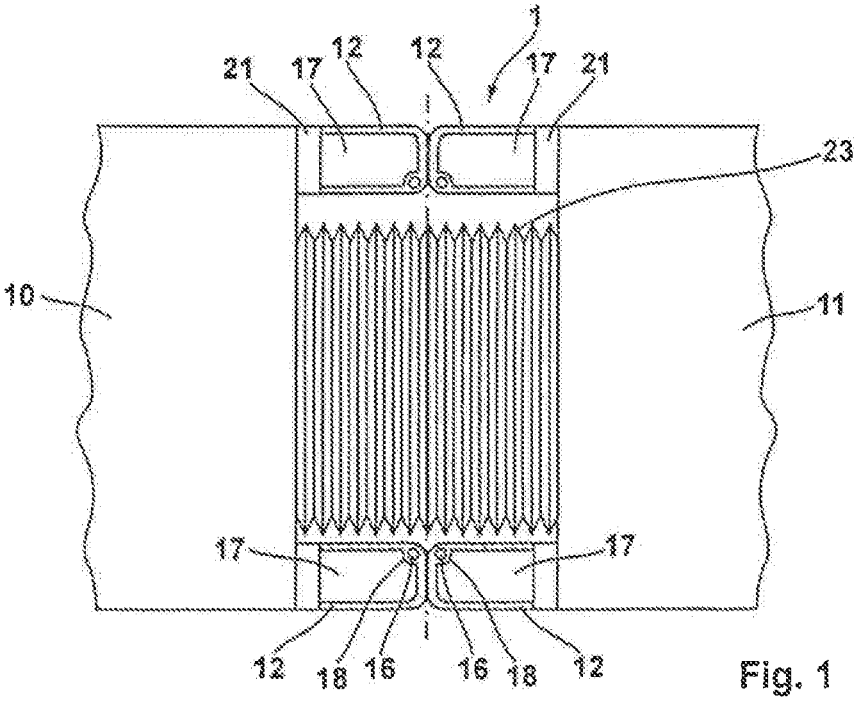
FIG. 1 is a plan view of a fairing in an arrangement between two vehicle parts.

FIG. 1 shows a schematized view of the arrangement of a fairing 1 between a first vehicle part 10 and a second vehicle part 11. The fairing 1 is part of a transition between the two vehicle parts 10, 11 and is arranged substantially aligned with the outer side of the vehicle parts 10, 11. An inner bellows 23 is located within the fairing 1 between the vehicle parts 10, 11. Together with further components, not shown, in particular a base assembly, the fairing 1 and the inner bellows 23 form a transition between two vehicle parts 10, 11.

The fairing 1 has a plurality of fairing elements 12 that are arranged peripherally at the respective front face of the vehicle parts 10, 11. The cross-sectional view of the fairing elements 12 consequently shows them in the side regions of the vehicle parts 10, 11.

The fairing elements 12 are arranged at the vehicle parts 10, 11 by means of mounting sections 21 and contact one another via associated contact surfaces at their front faces in an opposed arrangement. Consequently at least one fairing element 12 is arranged at each of the vehicle parts 10, 11 and said respective fairing elements are thus opposite one another and touch at their front faces.

Hollow chambers 17 are shown by the cross-sectioned view of the fairing elements 12 and are surrounded by the material walls and by the mounting sections 21 for mounting the fairing elements 12. In accordance with the invention, mounting passages 16 that are formed by material sections 18 of the fairing elements 12 are located at the inner side in the fairing elements 12. Stabilization bodies can be inserted into the mounting passages 16 such as shown and described in more detail in connection with the further FIGS. 3, 5, 6, and 7.

Figure 2:
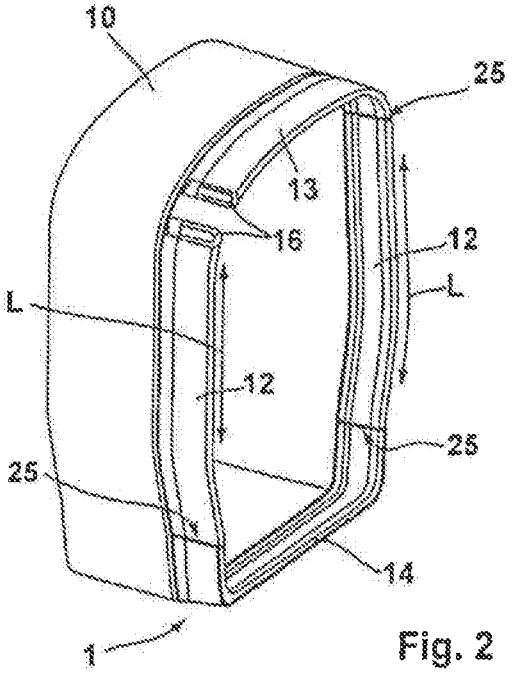
FIG. 2 is a perspective view of a vehicle part having a fairing arranged at a front face.

FIG. 2 shows a perspective view of a first vehicle part 10 to which a plurality of fairing elements 12, 13, and 14 are attached at the front face. The fairing elements 12, 13, 14 meet one another at abutment points 25 so that the front faces of the respective adjacent fairing elements 12, 13, 14 formed with respect to the longitudinal direction L of the fairing elements 12, 13, 14 contact one another.

In particular to stabilize the fairing elements 12, 13, 14 against one another, the mounting passages 16 are provided that extend in accordance with the embodiment in the longitudinal direction L over the total length of the fairing elements 12, 13, 14 and through them. The possibility is thus provided of leading a continuous stabilization body, for example in the form of a rope or of a chain, through the mounting passages 16 of the plurality of fairing elements 12, 13, 14 forming a ring closure.

Figure 3:
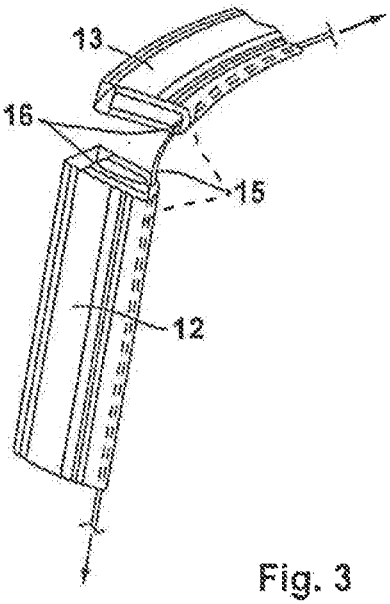
FIG. 3 is a sectional view of a fairing with two fairing elements.

FIG. 3 shows by way of example the arrangement of a stabilization body 15 in the form of a pulling means that is led through the mounting passages 16 in the fairing elements 12, 13. Due to a section through the fairing element 13, the illustration shows the fairing elements 12, 13 spaced apart from one another, that, however, contact one another in an arrangement at the vehicle parts 10, 11 in operation of the fairing 1. If a tension force is applied to the stabilization body 15 in the form of a rope or of a chain, indicated by arrows at the ends of the stabilization body 15, the front faces of the fairing elements 12, 13 are pressed onto one another and thus stabilized against one another in the transverse direction. A lateral movement of the fairing elements 12, 13 against one another is reduced or even avoided by this stabilization.

Figure 4:
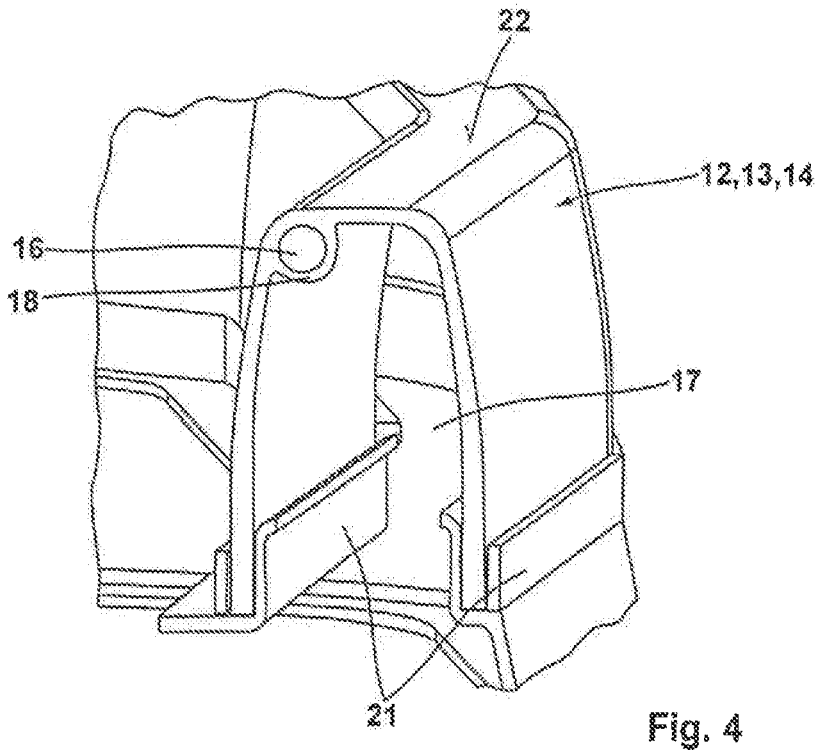
FIG. 4 is a perspective view of a fairing element from a front face with an arrangement of a mounting passage.

FIG. 4 shows a perspective view of a fairing element 12, 13, 14 that is mounted by means of a mounting section 21. The fairing element 12, 13, 14 has a material web in a U shape, with the mounting of the fairing element 12, 13, 14 taking place at the free ends of the two limbs of the U shape by means of the mounting section 21. On the cross-section between the two limbs of the U shape of the fairing element 12, 13, 14, a contact surface 22 is located at the outer side over which the fairing element 12, 13, 14 is brought into contact with an oppositely disposed fairing element, with the contact likewise taking place via a contact surface taking place at the complementary position of the further fairing element at the adjacent vehicle part.

A hollow chamber 17 in which a mounting passage 16 is produced is formed by the U shape of the fairing element 12, 13, 14. The formation of the mounting passage 16 takes place via a material section 18 of the material from which the fairing element 12, 13, 14 is also formed. The fairing element 12, 13, 14 can, for example, be manufactured from an elastomer in an extrusion process so that the material section 18 can be formed in a simple manner by means of a corresponding design of an extrusion die to form the mounting passage 16. The material section 18 is consequently formed in one part and with material unity with the material of the fairing element 12, 13, 14 so that a subsequent arrangement of the mounting passage 16 at the inner side of the hollow chamber 17 of the fairing element 12, 13, 14, for example by a sewing or by a joining with material continuity, is not necessary.

Figure 5:
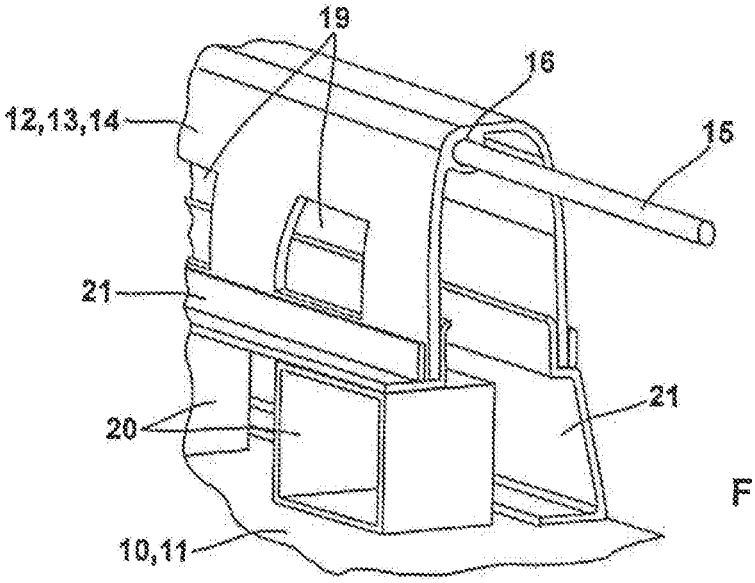
FIG. 5 is another perspective view of a fairing element that is mounted by installation sections and cut-outs at a side.

FIG. 5 finally shows a further perspective view of the fairing element 12, 13, 14 with lateral window-shaped cut-outs 19. In addition, an arrangement of installation sections 20 is shown that are located between the fairing element 12, 13, 14 and the vehicle part 10, 11. The arrangement of the installation sections 20 takes place, for example, toward the inner side into the transition between the vehicle parts 10, 11 and the further limb of the fairing element 12, 13, 14 is mounted on the outer side by means of the mounting section. The mounting passage 16 through which a stabilization body 15 in the form of a rope is led is additionally shown in the region of the hollow chamber 17 due to the cross-sectioned view of the fairing element 12, 13, 14. If a further fairing element 12, 13, 14 adjoins the face side of the shown fairing element 12, 13, 14, the stabilization body 15 can be led through in the likewise adjoining mounting passage 16 of the further fairing element.

The shown fairing elements 12, 13, 14 can have a coating at at least the outer side that forms a lacquer to improve the visual appearance of the fairing 1 and thus of the transition between the vehicle parts 10, 11. The lacquer film or the coating can in particular be on a polyurethane (PU lacquer) base, on a rubber (rubber lacquer) base, a polyvinyl chloride (PVC lacquer) base, a polytetrafluoroethylene (PTFE) base, or a thermoplastic film base. The possible application of such coatings or lacquers is based on the fact that an elastic deformation of the fairing elements 12, 13, 14 no longer occurs so strongly due to the arrangement in accordance with the invention of a stabilization body 15 between the fairing elements 12, 13, 14, in particular in an arrangement in a mounting passage, and the lacquers and coatings now only have to withstand slight deformations and stretching, which is what makes their use possible at all.

Figure 6:
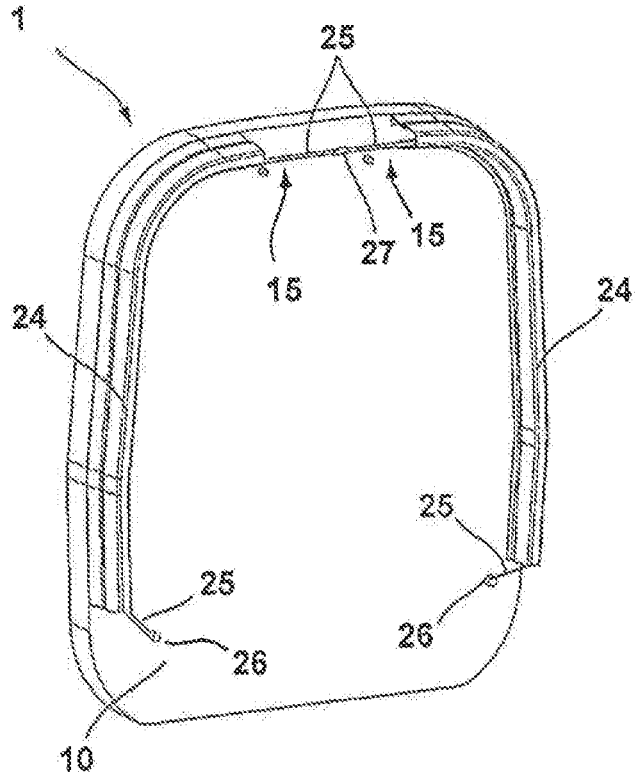
FIG. 6 is another embodiment of a fairing having individual fairing elements that are not adjacent to neighboring fairing elements at the front face.

A further embodiment of a fairing 1 is shown in FIG. 6 and individual fairing elements 24, that are thus not adjacent to neighboring fairing elements at the front face, are attached in the side regions at the front face of the vehicle part 10. The stabilization bodies 15 shown that are led through the fairing elements 15 for its stabilization are designed as respective ropes 25 and are connected to one another at the top side by a connection means 27. A section of the stabilization bodies 15 that is led out of the fairing elements 24 thus extends freely through the transition.

At the lower side, the ropes 25 are fastened to the front wall of the car part 10 by linking means 26. A tensioning means, not shown, can here be provided at at least one side and the rope 25 can be tensioned therewith.

Figure 7:
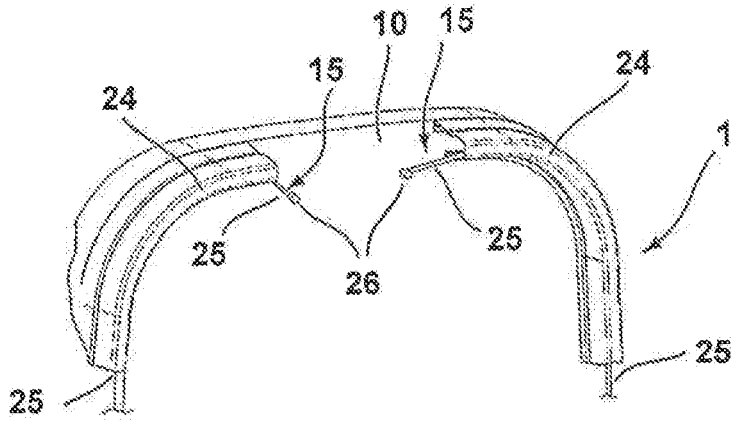
FIG. 7 is another embodiment of a fairing having individual fairing elements that are tensioned at the front wall of the vehicle by means of providing linking means.

FIG. 7 illustrates for this purpose that the stabilization bodies 15 in the form of ropes 25 can also be tensioned at the front wall of the vehicle part 10 by means of the linking means 26 in the upper region between the fairing elements 24 designed as curved.

As a result, the invention is thus directed to a stabilization body 15 in an arrangement in or at a fairing element 12, 13, 14, 24 that effects a stabilization of the generally elastic fairing element 12, 13, 14, 24 independently of whether a stabilization takes place by two mutually adjacent fairing elements 12, 13, 14 or whether a stabilization of a single fairing element 24 takes place at or against an installation environment, for example at the front wall of a vehicle part 10, 11.

The invention is not restricted in its design to the preferred embodiment indicated above. A number of variants are conceivable that also makes use of the solution shown with generally differently designed embodiments. All the features and/or advantages, including any construction details or spatial arrangements, originating from the claims, the description or the drawings can be essential to the invention both per se and in the most varied combinations. Thus, it is intended that the present invention covers the modifications and variations of this invention provided they come within the scope of the appended claims and their equivalents.

REFERENCE NUMERAL LIST

1 fairing
10 vehicle part
11 vehicle part
12 fairing element
13 fairing element
14 fairing element
15 stabilization body
16 mounting passage
17 hollow chamber
18 material section
19 cut-out
20 installation section
21 mounting section
22 contact surface
23 inner bellows
24 fairing element
25 rope
26 linking means
27 connection means
L longitudinal direction

The invention claimed is:

1. A fairing for arrangement between two vehicle parts, in particular of a rail vehicle, which are movably connected to one another, the fairing comprising:

a plurality of fairing elements each arranged at a vehicle part, the fairing elements each having at least one front face and a longitudinal direction (L), the fairing elements each being elastically deformable and having a U-shaped or arcuate cross-section; and at least one stabilization body extending at least sectionally into the fairing elements through the at least one front face of fairing elements;

wherein the at least one stabilization body comprises a first section and a second section;

the plurality of fairing elements being disposed adjacent to one another at their respective front faces along their longitudinal directions; and the first section of the at least one stabilization body extending into one of the fairing elements and the second section of the at least one stabilization body extending into another of the fairing elements.

2. The fairing in accordance with claim 1, wherein the plurality of fairing elements each have at least one mounting passage and a section of the at least one stabilization body extends into the at least one mounting passage.

3. The fairing in accordance with claim 2, wherein the plurality of fairing elements each have a hollow chamber, the at least one mounting passage being formed in the hollow chamber.

4. The fairing in accordance with claim 3, wherein the plurality of fairing elements each have a material section projecting into the hollow chamber and forming the at least one mounting passage, the fairing elements comprising an elastomer.

5. The fairing in accordance with claim 1, wherein the at least one stabilization body is a bar or a rod with oppositely disposed sections, the oppositely disposed sections extending into the fairing elements that are disposed adjacent to one another at their respective front faces.

6. The fairing in accordance with claim 2, wherein the at least one stabilization body is a rope, a belt, or a chain extending through the at least one mounting passage.

7. The fairing in accordance with claim 2, wherein the at least one mounting passage extends in the longitudinal direction (L) over a peripheral length through fairing elements, with the at least one stabilization body running through the mounting passages of at least two, of more than two, or of all the plurality of the fairing elements.

8. The fairing in accordance with claim 1, wherein the at least one stabilization body is a pulling means, a tension being applied to the pulling means with the pulling means being tensioned as a closed ring or with the ends of the pulling means being tensioned against a front wall of the vehicle part or against another body of an installation environment.

9. The fairing in accordance with claim 1, further having at least one installation section with a first side and a second side, the at least one installation section provided for the arrangement of the fairing elements at the vehicle part, the first side of the at least one installation section being arranged at the vehicle part and the fairing elements being arranged at the second side.

10. The fairing in accordance with claim 3, wherein the fairing elements each have a window-shaped cut-out through which the hollow chamber is accessible from an outer side of the fairing elements, the window-shaped cut-out being formed over a partial length or over a total length of the fairing elements.

11. A fairing element of a fairing for arrangement between two vehicle parts of a rail vehicle, which are movably connected to one another, comprising:

at least one fairing element having a U-shaped or arcuate cross-section with a hollow chamber, the at least one fairing element having a mounting section for mounting to one of the vehicle parts and an outer-side contact surface disposed away from the mounting section for contact with an oppositely disposed fairing element on the other of the vehicle parts;

a mounting passage formed in the U-shaped or arcuate cross-section adjacent the contact surface for receiving a stabilization body extendable into the U-shaped or arcuate cross-section for stabilizing the at least one fairing element.

12. The fairing element in accordance with claim 11, further comprising at least one material component for forming a material section of the at least one fairing element, the material section projecting into the hollow chamber and forming the mounting passage.

13. The fairing element in accordance with claim 11, wherein the U-shaped or arcuate design of the at least one fairing element having a base section and limbs projecting from the base section, the base section forming the outer-side contact surface, and the mounting passage being formed in at least one inner corner region between the base section and a limb in the U-shaped or arcuate cross-section of the at least one fairing element.

14. The fairing element in accordance with claim 13, wherein the U-shaped or arcuate design of the at least one fairing element having a peak section between the limbs for forming the outer-side contact surface and the mounting passage being formed in the peak section of the at least one fairing element.

* * * * *